US005326668A

United States Patent [19]

Waki

[11] Patent Number: 5,326,668

[45] Date of Patent: Jul. 5, 1994

[54] METHOD OF IMAGE FORMATION BY SILVER SALT DIFFUSION TRANSFER

[75] Inventor: Koukichi Waki, Kanagawa, Japan

[73] Assignee: Fuji Photo Film Co., Ltd., Kanagawa, Japan

[21] Appl. No.: 37,687

[22] Filed: Mar. 25, 1993

Related U.S. Application Data

[63] Continuation-in-part of Ser. No. 785,070, Oct. 30, 1991, abandoned.

[30] Foreign Application Priority Data

Nov. 1, 1990 [JP] Japan ..... 2-296401

[51] Int. Cl.[5] ..... G03C 5/54

[52] U.S. Cl. ..... 430/250; 430/230; 430/567; 430/569; 430/599

[58] Field of Search ..... 430/230, 567, 599, 250, 430/244, 247, 569

[56] References Cited

U.S. PATENT DOCUMENTS

| | | | |
|---|---|---|---|
| 3,206,313 | 9/1965 | Porter et al. | 430/599 |
| 3,864,131 | 2/1975 | Tanaka et al. | 430/250 |
| 4,165,986 | 8/1979 | Walworth | 430/230 |
| 4,444,877 | 4/1984 | Koitabashi et al. | 430/567 |
| 4,514,488 | 4/1985 | Idota et al. | 430/250 |
| 4,623,612 | 11/1986 | Nishikawa et al. | 430/567 |
| 4,677,052 | 6/1987 | Inoue | 430/230 |

*Primary Examiner*—Richard L. Schilling
*Attorney, Agent, or Firm*—Sughrue, Mion, Zinn, Macpeak & Seas

[57] ABSTRACT

A method of image formation disclosed, which comprises a method of image formation comprising developing a photosensitive element comprising an image-wise exposed photosensitive silver halide emulsion layer using an alkaline processing element containing a silver halide solvent to convert at least a part of the unexposed silver halide in the emulsion layer to a transferrable silver complex salt, and transferring at least a portion of the silver complex salt onto an image-receiving element comprising an image-receiving layer containing silver precipitation nuclei to form an image in the image-receiving element, wherein the silver halide grain in the photosensitive silver halide emulsion layer comprises silver iodobromide or silver chloroiodobromide having a silver iodide content of from 0.5 to 3.5 mol %; and wherein silver bromide or silver iodobromide is formed after chemical sensitization on the surface of the grains in an amount of from 3 to 20% in terms of silver.

10 Claims, No Drawings

METHOD OF IMAGE FORMATION BY SILVER SALT DIFFUSION TRANSFER

This is a continuation-in-part of application Ser. No. 07/785,070 filed Oct. 30, 1991, now abandoned.

FIELD OF THE INVENTION

The present invention relates to a method for forming an image by silver salt diffusion transfer, and a film unit for the method.

BACKGROUND OF THE INVENTION

The silver salt diffusion transfer process is well known, so that a description of the details of the process is not necessary. Specifically, this process is described in detail in various publications, e.g., A. Rott and E. Weyde: *Photographic Silver Halide Diffusion Processes,* Focal Press, 1972; J. Sturge, V. Walworth, and A. Shepp: *Imaging Processes and Materials:* Neblette's Eighth *Edition* Van Nostrand Reinhold, 1989, Chapter 6: "Instant Photography and Related Reprographic Process"; G. Haist: *Modern Photographic Processing,* Vol. 2, John Wiley & Sons, 1979, Chapter 8: "Diffusion Transfer"; and so forth.

This diffusion transfer process can be employed with various photographic materials as described in detail in the above-cited texts. In a known method, for example, a photosensitive element having a silver halide emulsion applied on a support is superposed upon an image-receiving element having an image-receiving layer containing silver precipitation nuclei on another support. A processing element which is composed of a highly-viscous alkaline processing composition containing a developing agent and a silver halide solvent is spread between the above two elements.

With the above construction, the photosensitive element is exposed to light, superposed on an image-receiving element, and then a processing element is spread between the above two elements. After a certain time the image-receiving element is removed with a transferred image thereon. Production of transferred images is always desired to be finished more rapidly.

In one method, the finishing of image transfer is accelerated by use of a developing agent having a high reducing power such as a hydroquinone and a silver halide solvent having high dissolving power such as hypo. In this method, however, problems are involved because the transferred images are quite unstable and cannot be preserved for a long term due to staining by an oxidation product of the developing agent and the formation of sulfide caused by a residual hypo. To stabilize the images, an oxidation-preventing layer such as polyvinyl alcohol layer containing an alkalineutralizing agent needs to be formed immediately after the image formation. This complicates the handling of the material.

In another method of acceleration of the finishing of a transferred image, silver chloride, silver chlorobromide, or the like which are highly soluble are used for the silver halide emulsion of the photosensitive element. This method, however, is disadvantageous because the photosensitive element cannot be used for photographing because of its low sensitivity, and because the density of the transferred image is low due to the tendency toward fogging.

SUMMARY OF THE INVENTION

The present invention provides a method of image formation using silver salt diffusion transfer in which image formation is rapidly finished and no image-stabilizing treatment of the finished image is required.

The present invention also provides a method of image formation using silver salt diffusion transfer in which image formation is rapidly finished with high photographic sensitivity retained.

The present invention provides a method of image formation comprising developing a photosensitive element having an image-exposed photosensitive silver halide emulsion layer usnig an alkaline processing element containing a silver halide solvent to convert at least a part of the unexposed silver halide in the emulsion layer to a transferrable silver complex salt, and transferring at least a portion of the silver complex salt onto an image-receiving element which has an image-receiving layer containing silver precipitation nuclei to form an image on the image-receiving element: the silver halide grain in the photosensitive silver halide emulsion layer comprising silver iodobromide or silver chloroiodobromide grains having an average silver iodide content of from 0.5 to 3.5 mol %; and silver bromide or silver iodobromide having a silver iodide content of not higher than 10 mol % being formed after chemical sensitization on the surface of the grains in an amount of from 3 to 20% as silver of the grain.

DETAILED DESCRIPTION OF THE INVENTION

Silver halide emulsion grains in the present invention have an average silver iodide content of 0.5 to 3.5 mol %, preferably of from 1.0 to 3.0 mol %, more preferably from 1.5 to 3.0 mol %. The silver iodide content is preferably varied between the interior and the surface of the grain. The higher the silver iodide content in the interior (e.g., 2 to 8 mol %) and the lower the silver iodide content around the surface (e.g., 0.5 to 3 mol %), then the higher is the sensitivity, the higher is the dissolving rate, and the more rapid by the transferred image can be finished. The silver chloride content is not specifically limited, but preferably is not higher than 10 mol % from the standpoint of sensitivity and the occurrence of fogging.

The formation of silver bromide or silver iodobromide on the grain surface after chemical sensitization is quite effective in attaining a high sensitivity without reducing the dissolution rate. The silver bromide or silver iodobromide is preferably formed in an amount of from 5 to 15% in terms of silver. In the formation of the silver iodobromide, the silver iodide content is preferably in the range of from 0.1 to 3.0 mol %. An excessively high content of the silver iodide will reduce the dissolution rate, retarding the finishing of the transfer image. The silver iodide or silver iodobromide may be formed by addition of silver ion and halogen ion after chemical sensitization, by addition of an emulsion of fine grains of silver bromide or iodobromide to recrystallize it on host grains by Ostwald ripening, or using like methods.

The silver halide grains may have any halogen composition distribution, including a homogeneous structure in which the composition is the same throughout the grain, or a lamination structure in which the core of the grain has a different composition from that of the grain shell (one or more layers) enclosing the core.

Alternatively, a structure in which non-laminar portions having different composition distributed in the interior or on the surface of the grains (portions of different compositions joined together at the edge, the corner or the face when the portions are on the grain surface). The latter two types of distribution are more advantageous in achieving a high sensitivity than a homogeneous structure, and are also preferable from the standpoint of pressure resistance. Where the silver halide grain has a nonhomogeneous structure as mentioned above, the portions having different halogen compositions may have a definite boundary or may have an indefinite diffuse boundary due to the formation of a mixed crystal, or otherwise intentionally may have a continuous structure change.

The silver halide grains may be those which form a latent image mainly on the surface thereof, or those which form a latent image mainly in the inner part thereof, or those which form a latent image uniformly therein. In particular, grains which form a latent image at a site exhibiting the highest sensitivity under the conditions described below are preferred.

Conditions for confirmation of latent image sites: A silver halide emulsion is applied onto a polyethylene terephthalate film in an amount of 1 g silver per $m^2$. Thereon a protective gelatin layer is provided. After exposure to light, the sample is developed with a processing solution of MAA-1+hypo at 20° C. for 20 minutes.

The silver halide grains in the silver halide emulsion may have a crystal form of the cubic system like a cube or octahedron, or may have an irregular crystal form such as a spherical or tabular form, or otherwise may be a comfirmation of such crystal forms.

The average size of the silver halide grain (which is represented by the diameter of an approximate circle of the projected area) is preferably not more than 4 μm, more preferably not more than 3 μm, still more preferably in the range of from 0.2 to 2 μm, but is not limited thereto. The distribution of the grain size may be broad or narrow.

The emulsion which can be employed in the present invention may be prepared using the methods described by P. Glafkides, *Chimie et Physique Photographigue,* Paul Montel, 1967; G.F. Duffin, *Photographic Emulsion Chemistry,* Focal Press, 1966; V.L. Zelikman, et al., *Making and Coating Photographic Emulsions,* Focal Press, 1964, and so forth. More specifically the emulsion may be prepared using any of an acid process, a neutral process, and an ammonia process. The soluble silver salt and the soluble halide salt may be reacted using any method such as a single jet mixing method, a double jet mixing method, and a combination thereof. The grains may be formed in the presence of excess silver ion (the so-called reverse mixing method). In one type of double jet mixing, the pAg value is kept constant in the liquid phase where the silver halide is formed using a method such as a controlled double jet method. This method gives a silver halide emulsion having grains in regular crystal form and nearly uniform grain size.

Various multivalent metal ion compounds may be added to the silver halide emulsion employed in the present invention in the process of emulsion grain formation or physical ripening of the grains. Suitable compound which can be added include salts of cadmium, zinc, lead, thallium, and the like, and salts and complex salts of elements of Group VIII of Periodic Table such as iron, ruthenium, rhodium, palladium, osmium, iridium, and platinum. In particular, compounds of elements of Group VIII are preferable. These compounds may be added in an amount over a wide range, preferably from $10^{-9}$ to $10^{-3}$ mole per mole of silver halide.

The silver halide emulsion employed in the present invention is usually subjected to chemical sensitization and spectral sensitization.

Chemical sensitization may be conducted according to the methods described in the abovementioned texts by Glafkides, Duffin, and Zelikman, and in H. Frieser, *Die Grundlagen der Photographischen Prozesse mit Silberhalogeniden,* Akademische Verlagsgesellschaft, 1968.

Suitable methods include sulfur sensitization which employs a compound having sulfur capable of reacting with active gelatin or silver, such as thiosulfate salts, thioureas, mercapto compounds, and rhodanines; noble metal sensitization which employs a noble metal compound such as gold complexes, and complexes of Group VIII of Periodic Table (e.g., platinum, iridium, Palladium, etc. ); reduction sensitization which employs a reducing substance such as stannous salts, amines, hydrazine derivatives, formamidinesulfinic acid, and silane compounds; and combinations thereof.

Preferable spectral sensitizing agents are cyanine dyes, merocyanine dyes, complex cyanine dyes, complex merocyanine dyes, holopolar cyanine dyes, hemicyanine dyes, styryl dyes, and hemioxanol dyes. Particularly useful dyes are dyes such as cyanine dyes, merocyanine dyes, and complex merocyanine dyes. Specific examples of these dyes are described in F. M. Hamer, *Heterocyclic Compounds—Cyanine Dyes and Related Compounds,* John Wiley and Sons, 1964. Also other useful spectral sensitizing agents are described in U.S. Pat. Nos. 2,493,748; 2,519,001; 2,977,229; 3,480,434; 3,672,897; 3,703,377; 2,688,545; 2,912,329; 3,397,060; 3,615,635, and 3,628,964; British Patents 1,195,302; 1,242,588, and 1,293,862; West Germany Patent Applications (OLS) 2,030,326, and 2,121,780; JP-B-43-4936; JP-B-44-14030, and JP-B-43-10773 ("JP-B" means an "examined Japanese patent publication"); U.S. Pat. Nos. 3,511,664; 3,522,052; 3,527,641; 3,615,613; 3,615,632; 3,617,295; 3,635,721, and 3,694,217; British Patents 1,137,580, and 1,216,203, and so forth.

The spectral sensitizing agents may be used as a combination of two or more thereof as described in JP-A-59-114533 and JP-A-61-163334 ("JP-A" means an "unexamined published Japanese patent application").

The thickness of the silver halide emulsion layer of the present invention is preferably in the range of from 0.5 to 8.0 μm, more preferably from 0.6 to 6.0 μm. The silver halide is coated preferably in an amount of from 0.1 to 3 $g/m^2$, more preferably from 0.2 to 1.5 $g/m^2$in terms of silver.

The photosensitive silver halide emulsion layer may contain various compound for prevention of fogging during manufacture and storage of the photographic materials or during photographic processing, and to stabilize the photographic properties.

Compounds for such purposes are well-known and examples are antifogging agents and stabilizers, including azoles (such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, nitrobenzotriazoles, and benzotriazoles ), mercaptopyrimidines, mercaptotriazines, thioketo compounds, azaindenes (such as triazaindenes, tetrazaindenes, and pentazaindenes), benzenesulfonic acids, benzenesulfonamides, α-lipo-acids, and the like. Typical examples are 1-phenyl-2-mercaptotetrazole, 4-hydroxy-6-methyl-l,3,3a,7-tetraazaindene, 2-mercaptobenzothizole, and 5-carboxybutyl-1,2-dithiolane. Further specific examples and the methods of use of such compounds are described, for example, in U.S. Pat. No. 3,982,947, and JP-B-52-28660.

The photosensitive element of the present invention may contain an organic or inorganic film-hardening agent, such as chromium salts (e.g., chromium alum, chromium acetate, etc.), aldehydes (e.g., formaldehyde, glyoxal, glutaraldehyde, etc.), N-methylol compounds (e.g., dimethylol-urea, methyloldimethylhydantoin, etc.), dioxane derivatives (e.g., 2,3-dihydroxydioxane, etc.), active vinyl compounds, (e.g., 1,3,5-triacryloyl-hexahydro-s-triazine, etc.), mucohalogenoacid (e.g., mucochloric acid, mucophenoxychloric acid, etc.), and the like, and a combination of two or more thereof can be used, if desired.

A coating aid may be employed in the silver halide emulsion layer and other hydrophilic colloid layers of the photosensitive element of the present invention. Suitable coating aids include the compounds described in *Research Disclosure,* Vol. 176, 17643, p. 26, Item "Coating Aids" (published December, 1978), and the compounds described in JP-A-61-20035.

The silver halide emulsion layer and other hydrophilic layers of the photosensitive element of the present invention may contain, for the purpose of increasing sensitivity, increasing contrast, or accelerating development, a compound such as a polyalkylene oxide, or its ether, a derivative of an ester or an amine, a thioether compound, a thiomorpholine, a quaternary ammonium compound, a urethane derivative, a urea derivative, an imidazole derivative, a 3-pyrazolidone, or the like. Specific examples thereof are described in U.S. Pat. Nos. 2,400,532; 2,423,549; 2,716,062; 3,617,280; 3,772,021; 3,808,003; etc.

The silver halide emulsion layer and other hydrophilic layers of the photosensitive element of the present invention may also contain a dispersion of a water-insoluble or slightly water-soluble synthetic polymer for the purpose of improving dimensional stability. Examples of suitable polymers are those derived from a monomer or a combination of monomers including alkyl (meth)acrylates, alkoxyalkyl (meth)acrylates, glycidyl (meth)acrylamides, vinyl esters (e.g., vinyl acetate), acrylonitrile, olefins, styrene, and the like; or a combination of the above monomer or monomers with acrylic acid, methacrylic acid, an α, β-unsaturated dicarboxylic acid, a hydroxyalkyl (meth)acrylate, styrenesulfonic acid, and the like.

The silver halide emulsion layer employed in the photosensitive element of the present invention may comprise a single layer or multiple layers. Further a protective layer may be provided on the silver halide emulsion layer. This protective layer may be formed of a hydrophilic polymer such as gelatin, and may contain a matting agent such as a polymethyl methacrylate latex and silica, or a slipping agent as described in JP-A-61-47946 and JP-A-61-75338.

The silver halide emulsion layer and other hydrophilic layers of the photosensitive element of the present invention may contain a dye or an ultraviolet absorbing agent as a filter or for preventing irradiation.

Furthermore, the photosensitive element of the present invention may contain an antistatic agent, a plasticizer, or an aerial-fog-preventing agent.

Gelatin is preferred as- the hydrophilic binder for the photosensitive element of the present invention, but other hydrophilic binders may be employed, including proteins (e.g., gelatin derivatives, polymer-grafted gelatin, albumin, casein, etc.), cellulose derivatives (e.g., hydroxyethylcellulose, carboxymethylcellulose, cellulose sulfate esters, etc.), sugars (e.g., sodium alginate, starch derivatives, etc.), and synthetic hydrophilic polymer (e.g., homopolymers of polyvinyl alcohols, partial acetals of polyvinyl alcohol, poly-N-vinylpyrrolidone, polyacrylamide, polyimidazole, poly-vinylpyrazole, etc., and their copolymers).

Gelatin which can be used in the present invention includes lime-treated gelatin, acid-treated gelatin, and enzyme-treated gelatin, e.g., as described in *Bull. Soc. Sci. Phot. Japan,* No. 16, p. 30 (1966). Further, hydrolysis products and enzyme-decomposition products of gelatin may also be employed.

Suitable gelatin derivatives which can be used include reaction products derived from reacting gelatin with an acid halide, an acid anhydride, an isocyanate, bromoacetic acid, an alkane sultone, a vinylsulfonamide, a maleimide compound, a polyalkylene oxide, an epoxy compound, or the like. Specific examples of such derivatives are described in U.S. Pat. Nos. 2,614,928; 3,132,945; 3,186,846; 3,312,553; British Patents 861,414; 1,033,189; 1,005,784; JP-B-42-26845.

Examples of polymer-grafted gelatin include those derived by grafting, onto gelatin, a homopolymer or a copolymer of vinyl monomers such as acrylic acid, methacrylic acid, an acrylic ester, acrylamide, acrylonitrile, styrene, or the like. Specific examples of these types of gelatin are described in U.S. Pat. Nos. 2,763,625; 2,831,767; 2,956,884, and so forth.

The image-receiving element of the present invention is produced by applying an image-receiving layer containing silver precipitation nuclei on a support such as baryta paper, polyethylene-laminated paper, a cellulose triacetate film, a polyester compound film, or the like. The image-receiving element is prepared preferably by applying a coating solution of a suitable cellulose ester, such as cellulose diacetate, containing silver precipitation nuclei dispersed therein, onto a support which may be coated with a subbing layer. The resulting cellulose ester layer is subjected to alkaline hydrolysis to convert at least a part thereof to cellulose in the depth direction. In a particularly preferable embodiment, the cellulose ester in the silver precipitation nucleus layer and/or underlying non-hydrolyzed underlayer, such as the portion of the cellulose ester layer containing unhydrolyzed cellulose diacetate, contains one or more mercapto compounds which are suitable for improving the color tone and the stability of the transferred silver image and other photographic characteristics. Such a mercapto compound is used by diffusion from its original position during imbibition. This type of image-receiving element is described in U.S. Pat. No. 3,711,283.

Preferable examples of mercapto compounds are described in JP-A-49-120634, JP-B-56-44418, British Patent 1,276,961, JP-A-56-21140, JP-A-59-231537, and JP-A-60-122939.

Specific examples of substances suitable as silver precipitation nuclei include heavy metals such as iron, lead, zinc, nickel, cadmium, tin, chromium, copper, and cobalt; and noble metals such as gold, silver, platinum, and palladium. Further examples of substances useful as silver precipitation nuclei are sulfides and selenides of the heavy metals and noble metals, in particular, the sulfides and selenides of mercury, copper, aluminum, zinc, cadmium, cobalt, nickel, silver, lead, antimony, bismuth, cerium, magnesium, gold, platinum, and palladium are useful. Among them, the sulfides of gold, platinum, and palladium are particularly preferred.

An acidic polymer layer for neutralization (or an alkali neutralizing layer) is preferably provided between the non-saponified layer (or the timing layer) and the support.

A polymeric acid, for example, described in U.S. Pat. No. 3,594,164 is preferably used for the alkali neutralizing layer. Preferable polymeric acids include maleic anhydride copolymer (e.g., a styrene-maleic anhydride copolymer, a methyl vinyl ether-maleic anhydride copolymer, a ethylene-maleic anhydride copolymer, etc.), and methacrylic or acrylic acid polymers or copolymers (e.g., an acrylic acid-alkyl acrylate copolymer, an acrylic acid-alkyl methacrylate copolymer, a methacrylic acid-alkyl acrylate copolymer, methacrylic acid-alkyl methacrylate copolymer, etc.).

Further, polymers containing a sulfonic acid such as polyethylene sulfonic acid, an acetal of benzaldehyde sulfonic acid with polyvinyl alcohol are also useful.

The neutralizing layer may contain a mercapto compound which is useful in the timing layer. Furthermore, a hydrolyzable alkali-non-permeable polymer (preferably any of the aforementioned cellulose esters) or alkali-permeable polymer may be used mixedly with the above polymeric acid can be present in the neutralizing layer for the purpose of improving the film properties.

The image-receiving element preferably includes an image-stabilizing layer for improving image preservability. Preferable stabilizing agents are a cationic polymer electrolyte, particularly including aqueous dispersion latexes as described in JP-A-59-166940, U.S. Pat. No. 3,958,995, JP-A-55-142339, JP-A-54-126027, JP-A-54-155835, and JP-A-53-30328; the polyvinylpyridinium salts described in U.S. Pat. No. 2,548,564, U.S. Pat. No. 3,148,061, and U.S. Pat. No. 3,756,814; water-soluble quaternary ammonium salt polymers described in U.S. Pat. No.-3,709,690; and water-insoluble quaternary ammonium salt polymers as described in U.S. Pat. No. 3,898,088.

Cellulose acetates, particularly cellulose diacetate of an acetylation degree of from 40 to 49% are preferred as the binder of the image stabilizing layer. This image-stabilizing layer is preferably provided between the above-described neutralizing layer and the timing layer.

The timing layer may contain an acidic polymer (e.g., a copolymer of methyl vinyl ether with maleic anhydride, a copolymer of methyl vinyl ether with a maleic anhydride half ester, etc.) for the purpose of prevention of prolongation of the timing length which occurs due to deterioration of the cellulose ester during prolonged storage or for the purpose of shortening the timing length. The timing length means a time until which an alkaline neutralizing layer initiates to decrease the pH of a processing solution remained in an image-receiving layer after separating.

The timing layer or the neutralizing layer may contain a white pigment (e.g., titanium dioxide, silicon dioxide, kaolin, zinc dioxide, barium sulfate, etc.) for the purpose of preventing penetration of light from the sectional direction into the interior of the sheet, namely light piping.

An intermediate layer may be provided between the image-receiving layer and the timing layer. Preferable materials therefor include hydrophilic polymers such as gum arabic, polyvinyl alcohol, polyacrylamide, and the like.

On the surface of the image-receiving layer, a releasing layer is advantageously provided to prevent adherence of the processing liquid on the image-receiving layer at the time of the layer-releasing operation after the spreading of the processing liquid. Preferable materials for the releasing layer are gum arabic, hydroxyethylcellulose, carboxymethylcellulose, polyvinyl alcohol, polyacrylamide, sodium alginate, and the materials disclosed in U.S. Pat. No. 3,772,024, U.S. Pat. No. 3,820,999, and British Patent 1,360,653.

Preferably for light interception, a light-intercepting agent (e.g., carbon black, organic black pigments, etc.) is incorporated in the supporting paper, or otherwise the light-intercepting agent is applied on the back side of the support, and further thereon a white pigment (e.g, titanium dioxide, silicon dioxide, kaolin, zinc dioxide, barium sulfate, etc.) is applied for whitening.

To decrease curling and brittleness, a moisture-absorbing agent such as glycerin, and a film-property-improving agent such as a polyethyl acrylate latex may be incorporated.

A protective layer is preferably provided on the uppermost layer. The protective layer may contain a mat agent for improving adhesive properties or enhancing writing suitability.

Suitable materials for the binder for the light-intercepting layer and the protective layer are gelatin, a cellulose ester, a polyvinyl alcohol, etc.

In the present invention, a preferable photo-sensitive element comprises a polyethylene terephthalate film containing titanium dioxide or carbon black as a support, a subbing layer on each surface thereof, and, on one surface of the support, a photosensitive silver halide emulsion layer and further thereon a protective layer, and on the other surface of the support, a carbon black layer and further thereon a protective layer.

Another preferable photosensitive element comprises a polyethylene terephthalate film containing titanium dioxide or carbon black as a support having a subbing layer on each surface thereof, and, on one surface of the support, a titanium dioxide layer and thereon a photosensitive silver halide emulsion layer and further thereon a protective layer, and on the other surface of the support, a carbon black layer and further thereon a protective layer. A coloring dye may be employed in place of or in addition to the carbon black, if desired. Where the polyethylene terephthalate contains carbon black and/or a coloring dye, a layer of carbon black and/or a coloring dye need not be provided. The titanium dioxide described above may be replaced by another white pigment, if desired.

The support may be made of another material than the above described polyester compound, such as a polyethylene-laminated paper, a baryta paper, and a cellulose triacetate film.

The photosensitive silver halide emulsion layer, the protective layer, the carbon black layer, and the like described above usually contain a hydrophilic binder such as gelatin.

The processing element is spread between the photosensitive element and the image-receiving element to cause a chemical development on an exposed portion in the photosensitive element, and further to cause a physical development on an unexposed portion in the image-receiving element by dissolving a silver halide on an unexposed portion. The processing composition of the processing element contains various kinds of additives. The processing composition is filled in a container, called "pod", under nitrogen atmosphere. The constitutional example of the pod is disclosed, e.g., in U.S. Pat. No. 2,543,181.

The processing composition of the processing element of the present invention contains, in addition to the above components, a developing agent, a silver halide solvent, an alkali agent, and a toning agent. The developing agent and/or the silver halide solvent may be present in the photosensitive element and/or in the image-receiving element, as necessary.

Suitable developing agents which can be used in the present invention comprise a benzene derivative having at least two hydroxyl and/or amino groups at the ortho- or para-positions, and a hydroxylamine, particularly a hydroxylamine substituted at the N atom thereof by a primary aliphatic group, a secondary aliphatic group, or an aromatic group, or a $\beta$-hydroxylamine. Suitable examples of benzene derivatives include hydroquinone, amidol, metol, glycine, p-aminophenol, pyrogallol, and the like. Specific examples of hydroxylamines are hydroxylamine, N-methylhydroxylamine, N-ethylhydroxylamine, those as described in U.S. Pat. No. 2,857,276, and N-alkoxyalkyl substituted hydroxylamines as described in U.S. Pat. No. 3,293,034.

Hydroxylamine derivatives which have tetrahydrofurfuryl group as described in JP-A-49-88521 may also be used.

Also aminoreductones described in West Germany Patent Applications (OLS) 2,009,054, (OLS) 2,009,055, and (OLS) 2,009,078, and heterocyclic aminoreductons described in U.S. Pat. No. 4,128,425 are useful.

Further, tetraalkyl reductic acid as described in U.S. Pat. No. 3,615,440 is useful.

A developing aid, may be such as phenidones, p-aminophenols, and ascorbic acid, may be used with the above described developing agent. The combined use of a phenidone is preferable.

Typical silver halide solvents which can be employed in the present invention include ordinary fixing agents (e.g., sodium thiosulfate, sodium thiocyanate, ammonium thiosulfate, and those described in the above referenced U.S. Pat. No. 2,543,181); a combination of a cyclic imide and a nitrogen base (e.g., a combination of barbiturate or uracil with ammonia or an amine); and the combinations described in U.S. Pat. No. 2,857,274. Known 1,1-bis-sulfonyl alkanes and their derivatives may also be used as the silver halide solvent in the present invention.

The processing composition contains an alkali, preferably an alkali metal hydroxide, such as sodium hydroxide and potassium hydroxide.

Where a processing compound is spread as a thin layer between the superposed photosensitive element and the image-receiving element, the processing element preferably contains a polymer-film-forming agent or a viscosity-building agent.

Example of the polymer-film-forming agents or the viscosity-building agents present in the processing element include cellulose derivatives, such as carboxymethylcellulose, ethylcellulose, hydroxyethylcellulose, methylcellulose, and hydroxypropylcellulose; vinyl polymers such as polyvinyl alcohol; acrylic acid polymers such as polyacrylic acid and polymethacrylic acid; inorganic polymers such as water glass; and the like. Among them, hydroxyethylcellulose and carboxymethylcellulose are particularly suitable. These are incorporated in the processing composition at an effective concentration to provide an appropriate viscosity suitable for the known diffusion transfer photographic process.

The processing composition may further contain other agents known in silver salt diffusion transfer process, such as an antifogging agent, a stabilizer, and the like.

The present invention is described in more detail by reference to the following Examples and Comparative Examples. Unless otherwise indicated herein, all parts, percents, ratios and the like are by weight.

EXAMPLE 1

1. Preparation of Image-Receiving Element

The layers below were formed successively on a polyethylene-laminated paper as a support to prepare an image-receiving element. The numerical values in the right show the coating amount in g/m$^2$.

| | | |
|---|---|---|
| (1) | Neutralizing Layer: | |
| | Cellulose Acetate (acetylation degree 55%) | 6.0 |
| | Methyl Vinyl Ether-Maleic Anhydride copolymer | 4.0 |
| | Uvitex OB (trade name, made by Ciba Geigy) | 0.04 |
| | 1-(4-Hexylcarbamoylphenyl)-2,3-dihydroxyimidazole-2-thione | 0.25 |
| (2) | Image-Stabilizing Layer: | |
| | Cellulose Acetate (acetylation degree: 46%) | 4.0 |
| | Compound shown below | 2.0 |

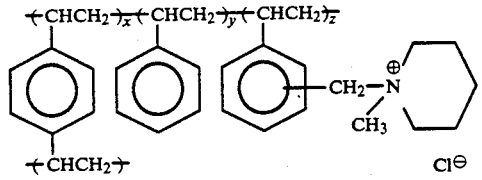

x:y:z = 5:47.5:47.5

| | | |
|---|---|---|
| (3) | Timing Layer: | |
| | Cellulose Acetate (acetylation degree: 55%) | 8.0 |
| (4) | Image-Receiving Layer: | |
| | Cellulose Acetate (acetylation degree: 55%) | 2.0* |
| | Palladium Sulfade | $7.5 \times 10^{-4}$ |
| | 1-(4-Hexylcarbamoylphenyl)-2,3-dihydroxyimidazole-2-thione | $1.0 \times 10^{-2}$ |
| (5) | Saponification Treatment: | |
| | Saponification was conducted from the surface of the layer with a liquid mixture of 12 g of sodium hydroxide, 24 g of glycerin, and 280 ml of methanol, and the saponified matter was washed with water. | |
| (6) | Releasing Layer: | |
| | Butyl Methacrylate-Acrylic Acid copolymer (mole ratio) = 15:85) | 0.1 |
| (7) | Back Layer: | |
| | A light-intercepting layer, a white layer, and a protective layer were applied on the back surface of the above support. | |
| (7-1) | Light-Intercepting Layer: | |
| | Carbon Black | 4.0 |
| | Gelatin | 8.0 |
| | Polyacrylate particles (average diameter: 0.05 μm) | 0.2 |
| (7-2) | White Layer: | |
| | Titanium Dioxide | 6.0 |

-continued

| | | |
|---|---|---|
| | Gelatin | 0.7 |
| (7-3) | Protective Layer: | |
| | Polymethyl Methacrylate Particles (average diameter: 0.05 μm) | 0.2 |
| | Gelatin | 1.6 |

2. Preparation of Photosensitive Element:

The layers below were formed successively on a support (made of polyethylene terephthalate) to prepare a photosensitive element. The numerical values in the right show the coating amount in g/m$^2$.

| | | |
|---|---|---|
| (1) | Colloidal Silver Layer: | |
| | Colloidal Silver (average particle diameter: 0.01 μm) | 0.002 |
| | Gelatin | 0.9 |
| (2) | Photosensitive Layer | |
| | Silver Iodobromide Emulsion (average grain diameter: 1.1 μm, AgI content: 6.5 mol %, homogeneous structure) | 0.55 as silver |
| | 4-Hydroxy-6-methyl-1,3,3a,7-tetrazaindene | 0.01 |
| | Sensitizing Dye A below | $3.2 \times 10^{-4}$ |
| | Sensitizing Dye B below | $3.2 \times 10^{-4}$ |
| | Sensitizing Dye C below | $1.2 \times 10^{-4}$ |
| | Gelatin | 3.9 |

(A)

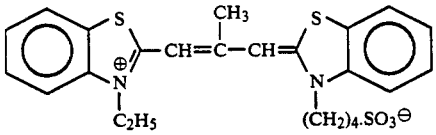

(B)

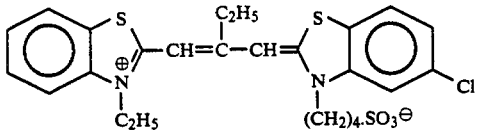

(C)

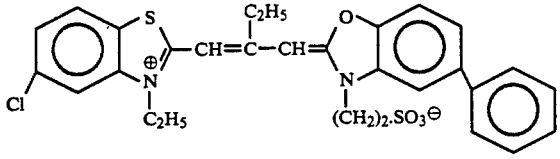

| | | |
|---|---|---|
| (3) | Protective Layer: | |
| | Gelatin | 0.7 |
| | Polymethyl Methacrylate Particles (average diameter 4.7 μm) | 0.1 |
| (4) | Back Layer: | |
| (4-1) | Light-Intercepting Layer: | |
| | Carbon Black | 4.0 |
| | Gelatin | 2.0 |

-continued

| | | |
|---|---|---|
| (4-2) | Protecting Layer: | |
| | Gelatin | 0.7 |
| | Polymethyl Methacrylate Particles (average diameter: 0.05 μm) | 0.1 |

The above photosensitive element was designated (1A). Other photosensitive elements (1B) to (1L) were prepared by replacing Silver Halide Emulsion (A) in Layer (2) with those shown in Table 1 below.

TABLE 1

| Photo-Sensitive Element | Emulsion | Host Grain Structure | Homogeneous Core/shell AgI (mol %) | Silver Added to Surface (%) | AgI Added to Surface (mol %) | Note |
|---|---|---|---|---|---|---|
| 1A | (A) | homogeneous | 6.0 | — | — | Comparison |
| 1B | (B) | core/shell | 6.0/3.0 | — | — | Comparison |
| 1C | (C) | homogeneous | 1.5 | — | — | Comparison |
| 1D | (D) | core/shell | 2.0/1.0 | — | — | Comparison |
| 1E | (E) | homogeneous | 2.5 | — | — | Comparison |
| 1F | (F) | core/shell | 4.0/1.0 | — | — | Comparison |
| 1G | (G) | homogeneous | 1.5 | 10 | 0 | Invention |
| 1H | (H) | core/shell | 2.0/1.0 | 10 | 0 | Invention |
| 1I | (I) | core/shell | 4.0/1.0 | 5 | 0 | Invention |
| 1J | (J) | core/shell | 4.0/1.0 | 10 | 0 | Invention |
| 1K | (K) | core/shell | 2.0/1.0 | 10 | 5 | Invention |
| 1L | (L) | core/shell | 4.0/1.0 | 10 | 20 | Comparison |

Emulsions (A) to (L) for Photosensitive Elements (1A) to (1L) were prepared as described below:

| Emulsion (A): | | |
|---|---|---|
| (a) | $H_2O$ | 1000 cc |
| | KBr | 6.6 g |
| | Gelatin | 16.7 g |
| (b) | $AgNO_3$ | 4.0 g |
| | $NH_4NO_3$ (50%) | 0.4 cc |
| | $H_2O$ | up to 30 cc |
| (c) | KBr | 2.6 g |
| | KI | 0.2 g |
| | $H_2O$ | up to 30 cc |
| (d) | Gelatin | 9.2 g |
| | $H_2O$ | 92 cc |
| (e) | KBr (30%) | 50 cc |
| (f) | $NH_4NO_3$ (50%) | 15 cc |
| (g) | NaOH (1N) | 56 cc |
| (h) | $H_2SO_4$ (1N) | 49 cc |
| (i) | KSCN (1N) | 37.8 cc |
| (j) | $AgNO_3$ | 46.0 g |
| | $NH_4NO_3$ (50%) | 3.0 cc |
| | $H_2O$ | 276 cc |
| (k) | KBr | 30.3 g |
| | KI | 2.7 g |
| | $H_2O$ | up to 276 cc |
| (l) | $AgNO_3$ | 50.0 g |
| | $NH_4NO_3$ (50%) | 3.3 cc |
| | $H_2O$ | up to 300 cc |
| (m) | KBr | 32.9 g |
| | KI | 2.9 g |
| | $H_2O$ | up to 300 cc |
| (n) | Gelatin | 37 g |

(a) was placed in a tank, and heated to 60° C. (b) and (c) were simultaneously added thereto within one minute. After 15 minutes, (d) and (e) were added thereto, and the mixture was physically ripened for 30 minutes. Further thereto, (f) and (g) were added, and the mixture was physically ripened for an additional 40 minutes. Subsequently thereto, (h) was added, and 2 minutes later, (j) and (k) were simultaneously added over a 30 minute period. At the time when 30% of (j) and (k) had been added, (i) was added. Then (l) and (m) were added simultaneously over a 20 minute period. Five minutes later, the temperature of the mixture was lowered to 40° C. The mixture was desalted three times. (n) was added thereto, and water was added to give a total volume of 800 g. After re-dispersion, the dispersed matter was brought to a temperature of 62° C., and subjected to optimum sulfur- and gold-sensitization using sodium thiosulfate, chloroauric acid, and potassium thiocyanate.

Emulsion (B):

Emulsion (B) was prepared in the same manner as Emulsion (A) except that the KI in (c) and (k) was used each in an amount of 6 mol % and the KI in (m) was used in an amount of 3 mol %.

Emulsion (C):

Emulsion (C) was prepared in the same manner as Emulsion (A) except that the KI in (c), (k), and (m) was used each in an amount of 1.5 mol %.

Emulsion (D):

Emulsion (D) was prepared in the same manner as Emulsion (A) except that the KI in (c) and (k) was used each in an amount of 2 mol % and the KI in (m) was used in an amount of 1 mol %.

Emulsion (E):

Emulsion (C) was prepared in the same manner as Emulsion (A) except that the KI in (c), (k), and (m) was used each in an amount of 2.5 mol %.

Emulsion (F):

Emulsion (F) was prepared in the same manner as Emulsion (A) except that the KI in (c) and (k) was used each in an amount of 4 mol % and the KI in (m) was used in an amount of 1 mol %.

Emulsion (G):

A fine-grain silver bromide emulsion (average grain size: 0.05 μm) was added to the same emulsion as Emulsion (C) in an amount of 10 wt % in terms of silver, and the mixture was ripened at 62° C. for 60 minutes to form silver bromide on the surface of the emulsion.

Emulsion (H):

A fine-grain silver bromide emulsion (average grain size: 0.05 μm) was added to the same emulsion as Emulsion (D) in an amount of 10 wt % in terms of silver, and the mixture was ripened at 62° C. for 60 minutes to form silver bromide on the surface of the emulsion.

Emulsion (I):

A fine-grain silver bromide emulsion (average grain size: 0.05 μm) was added to the same emulsion as Emulsion (F) in an amount of 5 wt % in terms of silver, and the mixture was ripened at 62° C. for 60 minutes to form silver bromide on the surface of the emulsion.

Emulsion (J):

A fine-grain silver bromide emulsion (average grain size: 0.05 μm) was added to the same emulsion as Emulsion (F) in an amount of 10 wt % in terms of silver, and the mixture was ripened at 62° C. for 60 minutes to form silver bromide on the surface of the emulsion.

Emulsion (K):

A fine-grain silver iodobromide emulsion (average grain size: 0.05 μm, AgI content: 5 mol %) was added to the same emulsion as Emulsion (D) in an amount of 10 wt % in terms of silver, and the mixture was ripened at 62° C. for 60 minutes to form silver iodobromide on the surface of the emulsion.

Emulsion (L):

A fine-grain silver iodobromide emulsion (average grain size: 0.05 μm, AgI content: 20 mol %) was added to the same emulsion as Emulsion (D) in an amount of 10 wt % in terms of silver, and the mixture was ripened at 62° C. for 60 minutes to form silver iodobromide on the surface of the emulsion.

3. Preparation of Processing Liquid and Preparation of Pod

The processing liquid was prepared under a nitrogen stream because the processing liquid is oxidized by air. The resulting processing liquid was filled in a plurality of rupturable pods in an amount of 0.7 g per pod to prepare the processing element.

| | |
|---|---|
| Titanium Dioxide | 5 g |
| Potassium Hydroxide | 280 g |
| Uracil | 90 g |
| Tetrahydropyrimidinethione | 0.2 g |
| 2,4-Dimercaptopyrimidine | 0.2 g |
| Sodium 3-(5-Mercaptotetrazolyl)-benzenesulfonate | 0.2 g |
| Zinc Nitrate (nona hydrate) | 40 g |
| Triethanolamine | 6 g |
| Hydroxyethylcellulose | 45 g |
| N,N-bis(Methoxyethyl)hydroxylamine (aqueous 17% solution) | 220 g |
| 4-Methyl-4-hydoxymethyl-1-phenyl-3-pyrazolidinone | 0.2 g |
| Water | 1300 ml |

4. Spreading Processing

The samples were prepared by assembling the image-receiving element, the photosensitive element (1A)-(1L), and the processing element mentioned above into a sample unit. Then, the samples were exposed through a continuous wedge under 16 lux (4800K) for 1/100 second. After exposure, the samples were subjected to spreading processing at 25° C. to give a liquid thickness of 35 μm, and the image receiving element was removed 15 seconds, 30 seconds, and 60 seconds after the spreading. The optical densities of the removed image-receiving elements were measured to evaluate the elements in terms of maximum density ($D_{max}$) and sensitivity ($S_{0.6}$). The sensitivity ($S_{0.6}$) is represented by the relative values of logarithm of the reciprocal of exposure at the point of $D_{min}+0.6$.

The results obtained are shown in Table 2 below.

TABLE 2

| Photo-sensitive element | Dmax 15 sec | Dmax 30 sec | Dmax 60 sec | $S_{0.6}$ 15 sec | $S_{0.6}$ 30 sec | $S_{0.6}$ 60 sec | Note |
|---|---|---|---|---|---|---|---|
| 1A | 0.94 | 1.84 | 1.96 | 1.90 | 1.70 | 1.70 | Comparison |
| 1B | 1.00 | 1.86 | 1.94 | 1.82 | 1.61 | 1.61 | Comparison |
| 1C | 1.24 | 2.05 | 2.05 | 1.25 | 1.11 | 1.11 | Comparison |
| 1D | 1.30 | 2.07 | 2.07 | 1.04 | 0.92 | 0.92 | Comparison |
| 1E | 1.16 | 1.95 | 1.95 | 1.57 | 1.40 | 1.40 | Comparison |
| 1F | 1.22 | 2.01 | 2.01 | 1.34 | 1.22 | 1.22 | Comparison |
| 1G | 1.26 | 2.04 | 2.04 | 1.86 | 1.75 | 1.75 | Invention |
| 1H | 1.33 | 2.05 | 2.05 | 1.85 | 1.77 | 1.77 | Invention |
| 1I | 1.25 | 2.02 | 2.02 | 1.90 | 1.80 | 1.80 | Invention |
| 1J | 1.26 | 2.02 | 2.02 | 1.92 | 1.83 | 1.83 | Invention |
| 1K | 1.23 | 2.01 | 2.01 | 1.96 | 1.86 | 1.86 | Invention |

TABLE 2-continued

| Photo-sensitive element | Dmax 15 sec | Dmax 30 sec | Dmax 60 sec | $S_{0.6}$ 15 sec | $S_{0.6}$ 30 sec | $S_{0.6}$ 60 sec | Note |
|---|---|---|---|---|---|---|---|
| 1L | 0.98 | 1.80 | 1.95 | 1.88 | 1.72 | 1.72 | Comparison |

As shown by the results in Table 2, Photosensitive Elements (1G) to (1K), of the present invention provide transferred images with higher sensitivities, more rapid finishing of image-transfer, and more satisfactory photographic characteristics in comparison with the Photosensitive Elements of the Comparative Examples (1A), (1B) and (1L). Photo-Sensitive Elements, (1C) to (1F) of the Comparative Examples provide transferred images which were finishing rapidly but with lower sensitivity.

EXAMPLE 2

Spreading and releasing procedures were conducted in the same manner as in Example 1 except that the processing liquid employed was prepared from the materials set forth below.

| | |
|---|---|
| Titanium Dioxide | 5 g |
| Potassium Hydroxide | 280 g |
| Uracil | 90 g |
| Sodium Thiosulfate | 2 g |
| Tetrahydropyrimidinethione | 0.2 g |
| 2,4-Dimercaptopyrimidine | 0.2 g |
| Sodium 3-(5-Mercaptotetrazolyl)-benzenesulfonate | 0.2 g |
| Potassium Iodide | 0.4 g |
| Zinc Nitrate (nona hydrate) | 40 g |
| Triethanolamine | 6 g |
| Hydroxyethylcellulose | 45 g |
| N,N-bis(Methoxyethyl)hydroxylamine (aqueous 17% solution) | 220 g |
| 4-Methyl-4-hydoxymethyl-1-phenyl-3-pyrazolidinone | 2 g |
| Water | 1300 ml |

The resulting processing liquid was filled in a plurality of rupturable pods in an amount of 0.7 g per pod to prepare the processing element.

The optical densities of the image-receiving elements, after the spreading and releasing, were measured, and evaluated at the maximum density ($D_{max}$) and the sensitivity ($S_{0.6}$). The results obtained are shown in Table 3 below.

TABLE 3

| Photo-sensitive element | Dmax 15 sec | Dmax 30 sec | Dmax 60 sec | $S_{0.6}$ 15 sec | $S_{0.6}$ 30 sec | $S_{0.6}$ 60 sec | Note |
|---|---|---|---|---|---|---|---|
| 1A | 1.60 | 1.80 | 1.87 | 2.00 | 1.92 | 1.92 | Comparison |
| 1B | 1.65 | 1.83 | 1.88 | 1.92 | 1.85 | 1.85 | Comparison |
| 1C | 1.76 | 1.80 | 1.80 | 1.48 | 1.44 | 1.44 | Comparison |
| 1D | 1.78 | 1.80 | 1.80 | 1.41 | 1.38 | 1.38 | Comparison |
| 1E | 1.70 | 1.80 | 1.81 | 1.60 | 1.56 | 1.56 | Comparison |
| 1F | 1.75 | 1.82 | 1.82 | 1.65 | 1.61 | 1.61 | Comparison |
| 1G | 1.78 | 1.80 | 1.80 | 1.96 | 1.94 | 1.94 | Invention |
| 1H | 1.80 | 1.81 | 1.81 | 1.96 | 1.95 | 1.95 | Invention |
| 1I | 1.77 | 1.80 | 1.80 | 1.98 | 1.97 | 1.97 | Invention |
| 1J | 1.77 | 1.80 | 1.80 | 1.99 | 1.99 | 1.99 | Invention |
| 1K | 1.78 | 1.81 | 1.81 | 2.02 | 2.01 | 2.01 | Invention |
| 1L | 1.58 | 1.76 | 1.83 | 2.00 | 1.94 | 1.94 | Comparison |

As shown clearly by the results in Table 3 above, Photosensitive Elements, (1G) to (1K), of the present invention provide transferred images with higher sensitivities, more rapid finishing of image-transfer, and more satisfactory photographic characteristics in comparison with the photosensitive elements of Comparative Examples, (1A) to (1F) and (1L). Photo-Sensitive Elements, (1G) to (1K), of present invention provide transferred images with little change in sensitivity and gradation with satisfactory photographic characteristics.

The present invention provides a film unit where the transferred image is finished rapidly and exhibits high sensitivity. The present invention also provide a method of image formation where an image stabilization treatment does not need to be used after the removal of an image-receiving member.

While the invention has been described in detail and with reference to specific embodiments thereof, it will be apparent to one skilled in the art that various changes and modifications can be made therein without departing from the spirit and scope thereof.

What is claimed is:

1. A method of image formation comprising developing a photosensitive element comprising an image-wise exposed photosensitive silver halide emulsion layer using an alkaline processing element containing a silver halide solvent to convert at least a part of the unexposed silver halide in the emulsion layer to a transferrable silver complex salt, and transferring at least a portion of the silver complex salt onto an image-receiving element comprising an image-receiving layer containing silver precipitation nuclei to form an image in the image-receiving element, wherein the silver halide grains in the photosensitive silver halide emulsion layer comprise silver iodobromide or silver chloroiodobromide having an average silver iodide content of from 0.5 to 3.5 mol %; and wherein silver bromide or silver iodobromide having a silver iodide content of not higher than 10 mol % is formed after chemical sensitization on the surface of the grains in an amount of from 3 to 20% by weight in terms of silver, and the alkaline processing element contains a hydroxylamine developing agent.

2. The method of claim 1, wherein the average silver iodide content of the silver halide grains is 1.0 to 3.0 mol %.

3. The method of claim 1, wherein the average silver iodide content of the silver halide grains is 1.5 to 3.0 mol %.

4. The method of claim 1, wherein the silver iodide content in the interior of the silver halide grains is higher than the silver iodide content at the surface of the silver halide grains.

5. The method of claim 1, wherein the silver chloride content of the silver halide grains is 10 mol % or less.

6. The method of claim 1, wherein the amount of the silver bromide or silver iodobromide formed on the surface after chemical sensitization of the silver halide grains is 5 to 15% in terms of silver.

7. The method of claim 1, wherein the chemical sensitization is by sulfur sensitization, noble metal sensitization, reduction sensitization or a combination thereof.

8. The method of claim 1, wherein the silver halide emulsion is spectrally sensitized.

9. The method of claim 1, wherein the silver precipitation nuclei comprise heavy metal nuclei, noble metal nuclei or compounds thereof.

10. The method of claim 1, wherein the hydroxylamine developing agent is substituted at the nitrogen atom by a substituent selected from the group consisting of a primary aliphatic group, a secondary aliphatic group and an aromatic group.

* * * * *